US006003703A

United States Patent [19]

Ruggeri et al.

[11] Patent Number: 6,003,703

[45] Date of Patent: Dec. 21, 1999

[54] BOTTLE HANDLING SYSTEM

[76] Inventors: Michele C. Ruggeri; George J. Ruggeri, both of 74 Clinton St., Malverne, N.Y. 11565

[21] Appl. No.: 08/761,118

[22] Filed: Dec. 6, 1996

[51] Int. Cl.[6] ..... B65D 23/10; B65D 25/28

[52] U.S. Cl. ..... 215/396; 220/758; 220/759; 220/770; 220/772; 294/27.1

[58] Field of Search ..... 215/396, 382–384, 215/386, 395; 220/669, 772, 770, 758, 755, 752, 741, 737, 672, 759, 743, 756, 694; 294/27.1, 31.2, 28

[56] References Cited

U.S. PATENT DOCUMENTS

| | | | |
|---|---|---|---|
| D. 264,942 | 6/1982 | Schieser et al. . | |
| 1,265,611 | 5/1918 | Clarke . | |
| 2,730,278 | 1/1956 | Sherlowsky | 220/741 |
| 2,755,977 | 7/1956 | Malcolm | 220/741 |
| 2,888,179 | 5/1959 | Daggett | 220/741 |
| 3,033,404 | 5/1962 | Adell | 215/383 X |
| 3,137,423 | 6/1964 | Tupper . | |
| 3,262,618 | 7/1966 | Miller | 220/743 X |
| 3,934,772 | 1/1976 | Brannan | 294/28 X |
| 4,308,955 | 1/1982 | Schieser et al. | 215/383 X |
| 4,669,627 | 6/1987 | Ueda et al. | 220/741 |
| 4,817,812 | 4/1989 | Sarnoff et al. . | |
| 4,852,760 | 8/1989 | Sarnoff et al. . | |
| 4,923,082 | 5/1990 | Bird | 220/759 X |
| 5,002,193 | 3/1991 | Touzani | 215/396 |
| 5,178,308 | 1/1993 | Endre | 215/383 X |
| 5,203,254 | 4/1993 | Fletcher . | |

*Primary Examiner*—Allan N. Shoap
*Assistant Examiner*—Niki M. Eloshway
*Attorney, Agent, or Firm*—Whitman Breed Abbott & Morgan LLP; Andrew L. Tiajoloff

[57] ABSTRACT

The bottle handle system uses a bottle having horizontal recesses in its sidewalls. Handle structures are provided with engagement portions that extend into the recesses in the sides of the bottle and provide handle portions that enable a user to readily pick up the bottle.

18 Claims, 3 Drawing Sheets

BOTTLE HANDLING SYSTEM

FIELD OF THE INVENTION

This invention relates to the field of bottles for fluids, and especially for systems for providing removable handles to place on the bottles.

DESCRIPTION OF THE PRIOR ART

Water coolers are usually provided with water by a bottle of water which is delivered to the site and replaced when empty. Normally, this bottle of water is fairly heavy, i.e., about 50 pounds, and presents a difficulty in handling due to the weight of the bottle and also its generally large dimensions.

A number of bottles exist in the prior art for transporting relatively large amounts of fluid, e.g., about 6 gallons or more. One such bottle is shown in U.S. design Pat. No. 264,942 to Schieser, et al, issued Jun. 15, 1982, which is herein incorporated by reference. Such bottles are quite good for delivery of water due to their stackable quality caused by their rectangular cross section, and are also reinforced by the series of corrugated ribs in the sides thereof. However, these bottles remain difficult to lift for the average person.

SUMMARY OF THE INVENTION

Accordingly, it is an object of the present invention to provide for a removable handle system which can be placed on a water bottle having recesses in its sides, and which system allows the user to easily pick the water bottle up.

Such a system has a water bottle which has vertically spaced lateral recesses in its sides. The handle element applied to the bottle has a central support structure, and four engagement portions supported on the support structures. Each engagement portion enters into and engages the bottle in a respective recess. A handle portion is also provided which gives access such that a user can grasp the handle with his hand and lift the bottle.

It is further an object of this invention to provide a pair of handle elements which, together, allow for a handle system which lifts the bottle readily, possibly by two people.

It is also an object of this invention to provide a design of a bottle handle system which is efficient and economical to produce.

Other objects and advantages the present invention will become apparent in this specification, and the invention will be described in the claims.

DETAILED DESCRIPTION OF THE INVENTION

Figure 1:
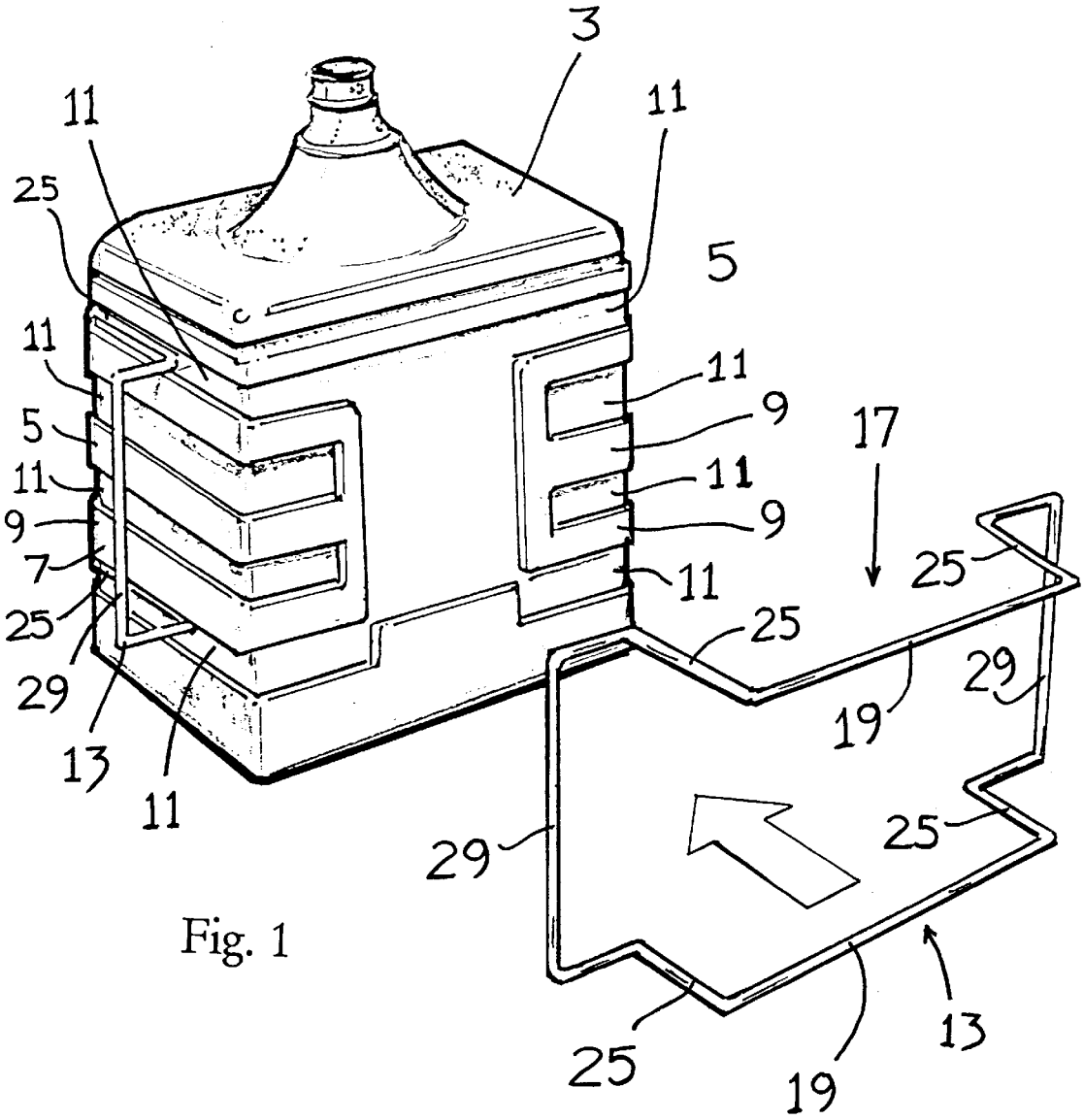
FIG. 1 shows the bottle handle system of the present invention in a partially exploded form.

As best shown in FIG. 1, the bottle handle system of the present invention is used with a bottle 3 containing fluid or some other pourable material of a relatively dense nature. The bottle of the preferred embodiment has a generally rectangular cross section in the horizontal plane, as defined by four walls 5. The walls have an outer surface 7 which defines a number of corrugations 9 and a number of vertically spaced horizontally extending recesses 11. These corrugations 9 help strengthen the bottle. In the preferred embodiment, the bottle holds about 6 gallons and weighs about 50 pounds.

In the preferred embodiment, the bottle handle system of the present invention comprises two handle structures 13. These handle structures 13 slide onto the bottle 3, and together, provide a handle system by which a user can readily lift the bottle.

Figure 2:
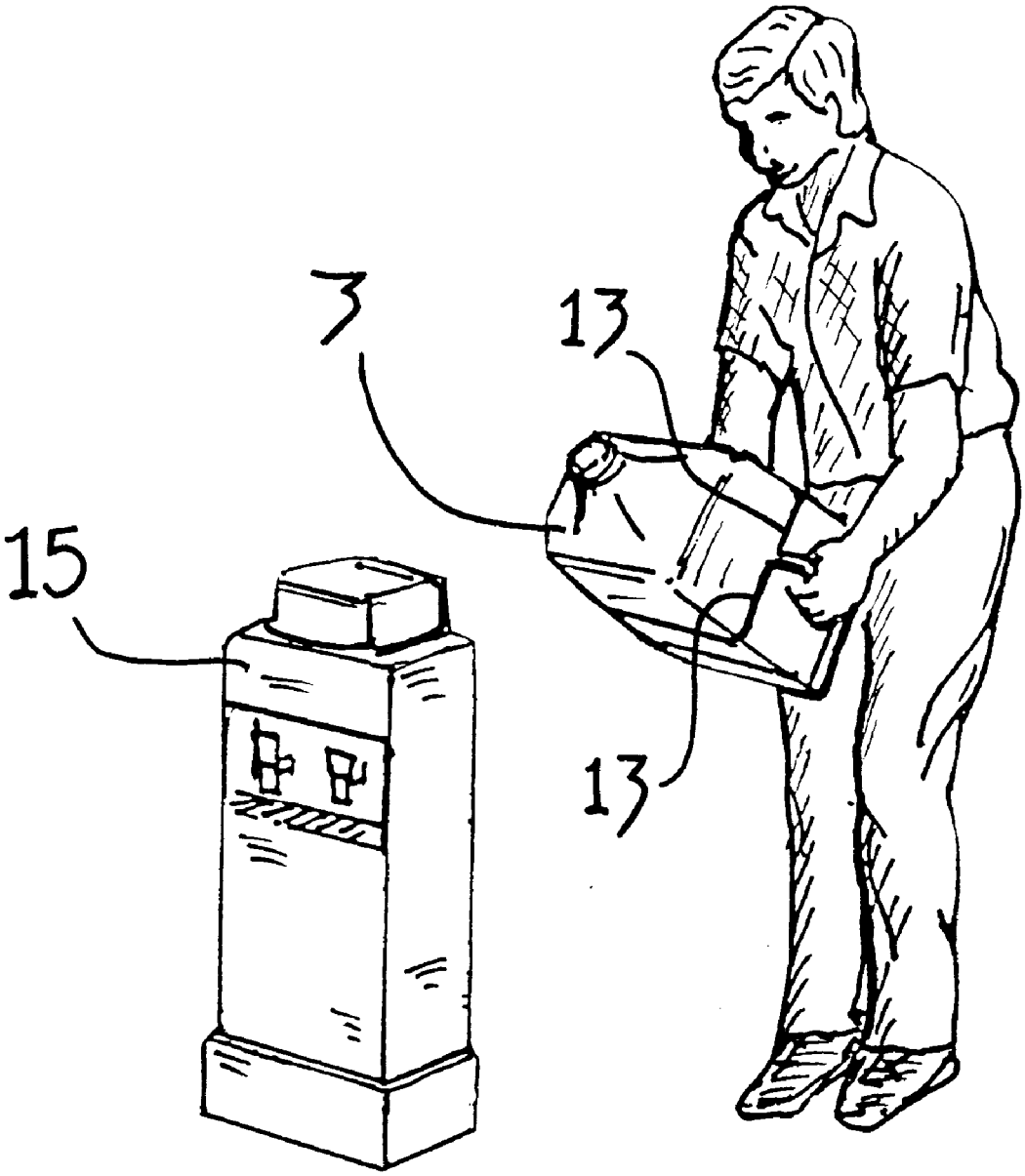
FIG. 2 shows a user making use of the bottle handle system to place a bottle in a water cooler.

Use of the handle system is shown in FIG. 2. In the preferred method of using the invention, an individual grasps the handle structures on both sides of the bottle 3 and then lifts the bottle and upends it to reload a water cooler indicated at 15.

The handle structures 13 are substantially identical so that there is no difficulty in placing them on the bottle 3. They are also symmetrical left to right and about a horizontal axis so that they can be used upside down or rightside up without any problems.

Figure 3:
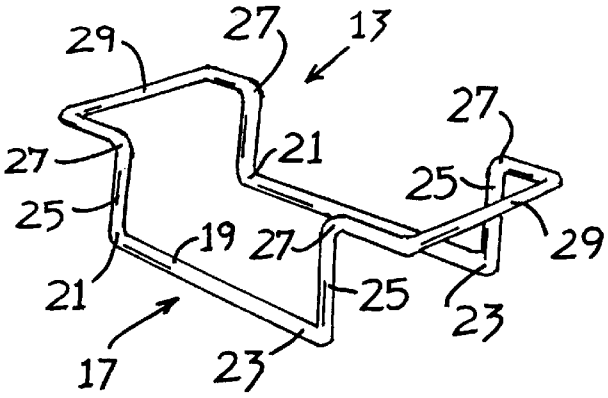
FIG. 3 is a perspective view of one of the handle structures of the present invention.
Figure 5:
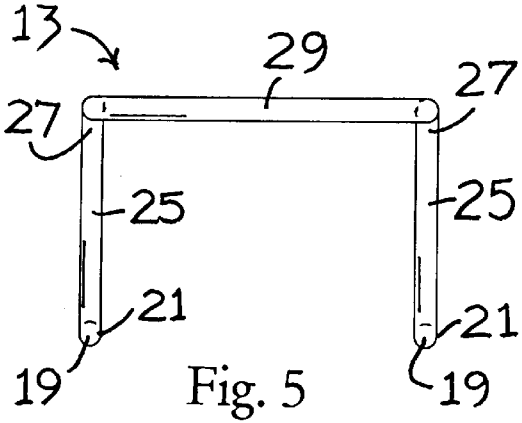
FIG. 5 is an end view of the handle structure of FIGS. 3 and 4.

As best seen in FIGS. 1 and 3, the handle structure 13 has a central support structure 17 formed of two horizontally extending support members 19. These support members 19 have two opposing ends at 21 and 23 each connected with a respective engagement portion 25. The engagement portions 25 are located so that they slide into recesses 11 on the sides of bottle 3 and engage the bottle 3 therein. Preferably, the engagement portions 25 are angled slightly inwardly from the connection with portions 19 so that there is a slight springing action that causes the handle structure 13 to squeeze or clamp onto the bottle, preventing it from falling off, but still permitting it to be slid off easily when desired.

The engagement portions 25 have two opposing ends, one of which is attached to the end 21, 23 of the associated support member 19. The other end 27 of the engagement portion 25 is connected with a generally U-shaped handle portion 29. The length of the engagement portion 25 is preferably such that both of the handle structure 13 can be pressed as far as possible onto the sides of the bottle, and the handle portions 29 of the two handle structure 13 will come together at approximately the midpoint of the side wall 7 of the bottle 3. This allows for a snug fit, and, as a consequence of the handles being adjacent, the user can readily grasp a handle portions 29 of each of the handle structures 13 with a single hand.

One advantage of the apparatus shown herein is that the handles on both sides of the bottle allow the bottle to be lifted by a single person, or alternatively by two people, one standing on each side of the bottle 3. In addition, the handle structures 13 of the present invention allow an individual to carry the bottle 3 in one hand by grasping the handle portions 29 on one side of the bottle. The bottle then gets carried like a suitcase. Also, in the event that the bottle is dropped, the handle portions 29 on the other side of the bottle act as a bumper to deflect impact on the bottle, which would otherwise possibly rupture it.

Figure 4:
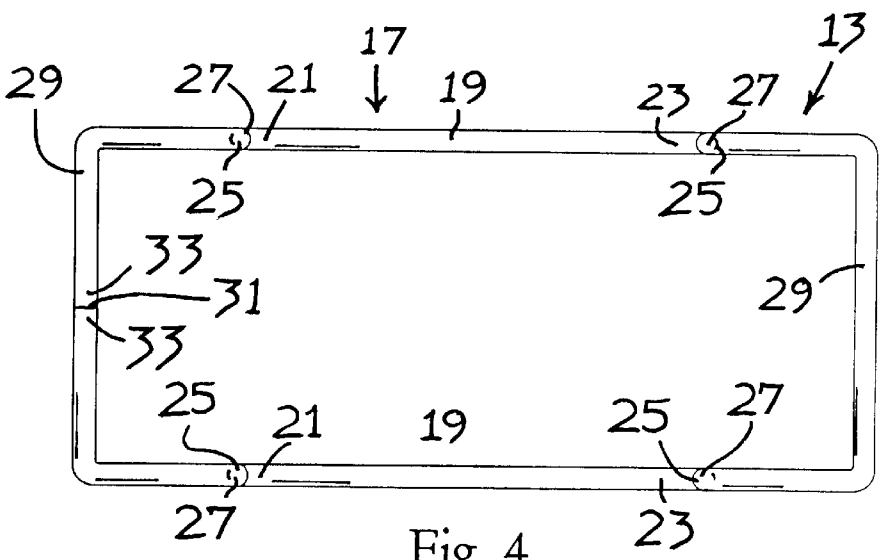
FIG. 4 is a plan view of the handle structure in FIG. 3.
Figure 6:
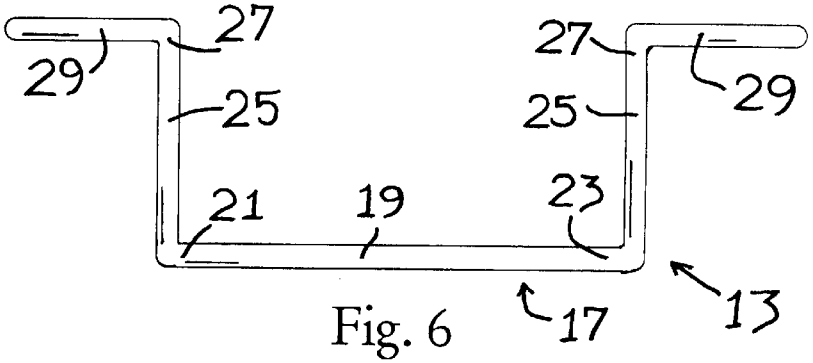
FIG. 6 is an elevational view of the handle structure of FIGS. 3, 4 and 5.

The handle portions of the present invention may be made in a variety of methods, as will be clear to one skilled in the art. One way of manufacturing the handle structure 13 using the present system is plastic injection molding. The preferred method is to manufacture each of the handle structure 13 from a single piece of stainless steel wire. Particularly preferred is stainless steel wire having a diameter of approximately 5/16 of an inch. Preferably, the handle structure 13 is formed into a unified structure by butt weld 31 between the two ends of the wire 33, as best shown in FIG. 4.

For the most commonly used bottles of the present invention, the length of the support from members 19 between the engagement portions is about 11⅛ inches. The length of the engagement portions 25 is about 4¼ inches. The handle structures 24 are preferably 7⅛ inches wide and extend about 2 to 3 inches away from the external surface 7 of the bottle 3, and most preferably about 2¼ inches from where they connect with the engagement portions.

Although the squeezing of the bottle 3 between the engagement portions 25 should be sufficient to retain the handle structures 13 on the bottle and with the handle portions 29 in close proximity to each other, optionally the two handle structures 13 may be secured to each other by a Velcro strap (not shown) or other securing structures, extending around and securing the handle portions 29 of each of the handle structures 13 to each other.

The handle structures of the present invention may be colored by a variety of finishes well known in the art. For instance, vinyl PVC may be used as a coating. Particularly preferred however, is a powder coat or a metal plating (e.g., anodizing) of the wire.

The terms used herein should be considered words of description rather than limitation, as those skilled in the art with this disclosure before them will be able to make modifications therein without departing from the spirit of the invention.

We claim:

1. A bottle-handling system comprising:

a bottle having an enclosed structure defining therein an interior space of the bottle in which space a liquid is placed, said enclosed structure including first and second longitudinally extending vertical side walls spaced in a lateral direction of each other on either side of the interior space;

said side walls each defining an outwardly disposed horizontal recess therein; and a removable handle element comprising a support frame extending in the lateral direction adjacent the bottle, first and second laterally spaced engagement portions connected with the support frame, each engagement portion extending longitudinally and horizontally therefrom into a respective recess in a respective side wall and engaging the respective side wall of the bottle therein, and first and second handle portions each connected with a respective engagement portion, said first and second handle portions each extending fixedly laterally outward of the bottle from the respective side wall and engagement portion, each of said handle portions providing access for a hand of a user on opposing sides of the bottle, the handle element being configured so that the engagement portions can be slid in and out of engagement with the recesses without deforming the handle element, the engagement portions being entrained in the respective recesses against vertical movement relative to the bottle, whereby one or two users can lift the bottle by grasping and lifting said first and second handle portions.

2. The system according to claim 1 and said engagement portions being biased together so that the handle element springingly grips said bottle.

3. The system according to claim 1 and said handle element being formed of a single piece of metallic wire material.

4. The system according to claim 1 and further comprising means for releasably retaining the removable handle element on the bottle.

5. A bottle-handling system comprising:

a bottle having an enclosed structure defining therein an interior space of the bottle in which space a liquid is placed, said enclosed structure including first and second longitudinally extending vertical side walls spaced in a lateral direction of each other on either side of the interior space;

said side walls each defining an outwardly disposed horizontal recess therein; and a removable handle element comprising a support frame extending in a lateral direction adjacent the bottle, first and second engagement portions connected with the support frame and each extending into a respective recess in a respective side wall and engaging the bottle therein, and a handle portion connected with one of said engagement structures, said handle portion providing access for a hand of a user so as to enable the user to pick up the bottle by grasping said handle portion, and a second handle element supported on an opposite side of the bottle from the first handle element, said second handle element having a support frame and first and second engagement portions connected with the support frame and each extending into a respective recess and engaging the bottle therein; and said second handle element further comprising a second handle portion connected with one of the engagement portions of the second handle element, said second handle portion being adjacent the first handle portion and configured so as to enable the user to grasp both of the handle portions together with the user's hand.

6. A bottle-handling system comprising:

a bottle comprising an enclosed structure containing fluid, and said enclosed structure having a bottom and an outer surface extending upwardly therefrom, said outer surface defining a first pair of outwardly disposed recesses extending in a first horizontal plane and a second pair of outwardly disposed recesses extending in a second horizontal plane displaced vertically from said first plane;

a removable handle element engaging the bottle, said handle element having two pairs of engagement portions, each of said engagement portions extending horizontally within a respective recess and engaging the outer surface of the bottle therein so that the handle element is entrained against vertical movement relative to the bottle and sliding in a horizontal direction is possible, and said handle element comprising at least one handle portion operatively associated with one of the pairs of engagement portions, said handle portion providing access for a hand of a user so as to enable the user to pick up the bottle by grasping the handle portion, and a second handle element engaging the bottle, said second handle element comprising two further pairs of engagement portions, each of said engagement portions extending within a respective recess and engaging the outer surface of the bottle therein so that the handle element is entrained against vertical movement relative to the bottle and sliding in a horizontal direction is possible, and at least one further handle portion operatively associated with one pair of said further engagement portions, said handle portion providing access for the hand of the user so as to enable the user to pick up the bottle by grasping said further handle portion of said second handle element; and the handle portion of said second handle element being adjacent the handle portion of the first handle element so as to enable the user to grasp both handle portions together with a single hand.

7. A bottle-handling system comprising:

a bottle comprising an enclosed structure containing fluid, and said enclosed structure having a bottom and an outer surface extending upwardly therefrom, said outer surface defining a first pair of outwardly disposed recesses extending in a first horizontal plane and a second pair of laterally outwardly disposed recesses extending in a second horizontal plane displaced vertically from said first plane;

a removable handle element engaging the bottle and being configured to slide in and out of engagement with the bottle, said handle element having four engagement portions connected therewith, each of said engagement portions extending within a respective recess and engaging the outer surface of the bottle therein, the engagement portions being slidable horizontally out of engagement in the recesses and being entrained therein against vertical movement relative to the bottle, and said handle element further comprising a support structure extending laterally adjacent the bottle and supporting said engagement portions;

a first handle portion being connected with two of said engagement portions, a second handle portion connected with the other two of said engagement portions;

said handle portions each fixedly projecting laterally away from said engagement portions and outward of said bottle and said outer surface, said handle portions each providing a gripping portion supported laterally outward of the bottle so as to enable one or more users to lift the bottle by grasping and lifting the gripping portions.

8. The system according to claim 7 and said handle element biasing said engagement portions inwardly of the bottle and causing said engagement portions to springingly clamp the handle element to the bottle.

9. The system according to claim 7 and said support structure having two opposing lateral ends, one of said ends being connected with the two engagement portions connected with the first handle portion, and the other of said ends being connected with the engagement portions connected with the second handle portion.

10. The invention according to claim 9 and said support structure comprising first and second vertically spaced, laterally extending support members each having a pair of opposed lateral end portions, each of said lateral end portions being connected with a respective engagement portion.

11. The system according to claim 10 and said support members, engagement portions and handle portions being formed from metallic wire.

12. The system according to claim 7 and further comprising means for releasably retaining the removable handle element on the bottle.

13. A bottle-handling system comprising:

a bottle comprising an enclosed structure containing fluid; and said enclosed structure having a bottom and two laterally spaced opposing walls extending upwardly therefrom, said walls each having an outer surface defining at least two vertically spaced, outwardly disposed recesses;

first and second handle structures supported on said bottle, each of said handle structures comprising at least four engagement portions, two of said engagement structures each engaging the bottle in a respective recess in one of the walls, and two of the engagement portions each engaging the bottle in a respective recess in the other wall of the bottle; and two handle portions, each of said handle portions being connected with the two of the engagement portions in the recesses in a respective wall;

a support structure extending laterally adjacent the bottle and connecting at least one of the engagement portions in said one of the walls with at least one of the engagement portions in said other of the walls of the bottle;

each of the handle portions of the first handle structure being adjacent to a respective handle of the second handle structure and permitting a user to grasp with a hand simultaneously one of the handle portions of the first handle structure and one of the handle portions of the second handle structure.

14. The system according to claim 13 and said support structures each comprising a pair of vertically spaced, laterally extending support members each having two opposing ends, each of said ends being connected with a respective engagement member.

15. The system according to claim 14 and each of said engagement portions having opposing end portions, one of said end portions being connected with the respective end of the support member, the other of said end portions being connected with the associated handle portion.

16. The system according to claim 15 and the support members, the engagement portions, and the handle portions of each of the handle structures formed integral with each other.

17. The invention according to claim 15 and each of said handle structures being of metallic wire.

18. The invention according to claim 13 and said handle structures being configured so that at least two of the engagement portions pinch the bottle and secure the handle structures thereon.

* * * * *